US005293816A

United States Patent [19]

Musumeci, Sr. et al.

[11] Patent Number: 5,293,816

[45] Date of Patent: Mar. 15, 1994

[54] REDUCED HAND FORCE CAN CRUSHING APPARATUS

[76] Inventors: Joseph A. Musumeci, Sr.; Joseph A. Musumeci, Jr., both of 11 Lake Ave., Swedesboro, N.J. 08085

[21] Appl. No.: 984,691

[22] Filed: Dec. 2, 1992

[51] Int. Cl.[5] ..... B30B 1/02; B30B 1/26; B30B 9/32

[52] U.S. Cl. ..... 100/245; 100/283; 100/291; 100/293; 100/902

[58] Field of Search ..... 100/245, 283, 291, 293, 100/902

[56] References Cited

U.S. PATENT DOCUMENTS

| | | | |
|---|---|---|---|
| 6,690 | 9/1849 | Hobbs et al. . | |
| 359,515 | 3/1887 | Neeb | 100/283 |
| 563,441 | 7/1896 | Bishop | 100/283 |
| 660,671 | 10/1900 | Tuttle . | |
| 799,225 | 9/1905 | Dean | 100/293 X |
| 819,546 | 5/1906 | Holderfield et al. | 100/283 X |
| 839,579 | 12/1906 | Hailey | 100/283 |
| 870,023 | 11/1907 | Easterling | 100/283 X |
| 899,502 | 9/1908 | Bennett | 100/291 X |
| 964,823 | 7/1910 | Taylor | 100/283 X |
| 2,763,202 | 9/1956 | Gramelspacher | 100/52 |
| 3,027,829 | 4/1962 | Brey | 100/271 |
| 4,062,283 | 12/1977 | Kaminski | 100/293 X |
| 4,213,387 | 7/1980 | McCaney et al. | 100/245 |
| 4,216,713 | 8/1980 | Jung | 100/209 |
| 4,248,144 | 2/1981 | Morgan | 100/244 |
| 4,291,618 | 9/1981 | Heiser et al. | 100/35 |
| 4,301,722 | 11/1981 | Balbo et al. | 100/218 |
| 4,345,520 | 8/1982 | Goldsmith et al. | 100/293 |
| 4,475,449 | 10/1984 | Gianelo | 100/42 |
| 4,517,892 | 5/1985 | Meisner | 100/293 X |
| 4,653,398 | 3/1987 | Fowler | 100/233 |
| 4,667,593 | 5/1987 | Kennedy | 100/215 |
| 4,976,196 | 12/1990 | Phillips et al. | 100/233 |
| 5,121,685 | 6/1992 | Turner | 100/49 |
| 5,179,893 | 1/1993 | Richardson | 100/293 X |

FOREIGN PATENT DOCUMENTS

| | | | |
|---|---|---|---|
| 2109962 | 9/1972 | Fed. Rep. of Germany | 100/902 |
| 58-119498 | 7/1983 | Japan | 100/902 |
| 59-174299 | 10/1984 | Japan | 100/902 |
| 60-72699 | 4/1985 | Japan | 100/902 |
| 62-97798 | 5/1987 | Japan | 100/283 |

*Primary Examiner*—Stephen F. Gerrity
*Attorney, Agent, or Firm*—Thomas A. Lennox

[57] ABSTRACT

A hand operated can crushing apparatus installed on a vertical wall or on top of a storage container to crush individual cans and allow them to drop into the storage container using an apparatus with a housing that includes an inside channel to crush the cans between a moving piston surface and an end of the housing with the force applied by a handle that is pivotally connected to a rear end of the housing to pivot downwardly above the housing forcing the piston member to slide lengthwise in the channel. Force against the piston member is first applied through a convex cam surface extending frontwardly from a rear end of the handle member against a rotating wheel cam follower and then through a lever connected at one end to a median position on the handle and at the other end to the piston member with the connecting apparatus of the lever delaying the effect of that lever until the piston movement has moved the cam follower wheel out of range of the cam surface.

15 Claims, 3 Drawing Sheets

REDUCED HAND FORCE CAN CRUSHING APPARATUS

BACKGROUND OF THE INVENTION

This invention involves an apparatus to crush empty cans that is operated by hand and more specifically involves an apparatus to crush empty soda or beer cans end to end with a substantially reduced physical effort and to smaller volume.

The single most effective recycling program is that of empty aluminum cans, most of which have been previously filled with soda or beer. In particular, the recycling of aluminum cans is the most environmentally effective program in that the energy costs to reuse the metal from the recovered cans is only a fraction of that necessary to produce aluminum metal from the ore. The recycling of the empty cans is an established element of commerce which not only benefits society but in removing cans from the highways and byways but provides free enterprise funding for recycling including collection and reuse disposal. The major problem in the collection process is that the empty cans take up a major volume with very little weight. The recycling effort encourages the purchaser or the vendor to return the empty containers ultimately to the can manufacturers. Unfortunately, these procedures cause a number of storage and transportation problems. Many facilities collect a large number of cans, such as restaurants, cafeterias, manufacturing facilities that have at least one and typically a large number of can dispensing coin operated machines. In a relatively short period of time, the volume of empty cans collected causes a major problem. Empty cans take up as much space as full cans in the home of the consumer, in the storeroom of the store, and in the cargo compartment of a truck. The requirement of storing and handling these used cans creates inconvenience for all parties and increases overhead expenses that could exceed the savings resoluting from the recycling of the materials. It has thus been desirable to crush the empty cans so that they will take only a fraction of the space during recovery process. Over the last few years, it has been common to have can crushers located close to the source of the empty soda or beer cans for use either by the employees of a food dispensing establishment or the customers themselves. However, the can crushers in the market either require substantial physical effort to crush the can, are too complicated and expensive, or pose a significant risk of injury to the hands during the crushing operation. A common portable can crushing apparatus is described in U.S. Pat. No. 4,345,520 to Goldsmith et al. Commerical can crushers of that general design are supplied without the elongated wedge on the face of the piston. These devices include a housing using a similar lever mechanism to that of Goldsmith et al with an opening in the bottom of the housing sized to allow the crushed can to drop downwardly into a collecting container in a fashion as illustrated in FIG. 1, although that figure illustrates a device and method of the present invention. These devices require about forty to forty-five pounds force being applied to the handle in order to crush the can. Further, they pose a substantial risk of slicing or crushing fingers in the device during the can crushing operation.

While a number of industrial can crushing apparatus suitable for use at a recycling collection site may be powered by electric motors and are safe to handle, such devices are not practical for a basically commerical or consumer use at the site of consumption of the canned drinks.

None of the prior art devices satisfy these problems or attain the objects of the present invention described hereinbelow.

SUMMARY OF THE INVENTION

It is an object of the present invention to provide a can crushing apparatus utilizing a hand operating lever to crush the can and allow the cans to drop downwardly from the apparatus into a storage container.

It is a particular object of the present invention to provide an apparatus that requires no more than about eight to ten pounds of force on the handle to crush the can. It has been observed that the initial force to start the crushing of the can is substantially greater than that necessary to crush the cylindrical sides of the can, once a side has crumpled. The object of this invention provides increased leverage with limited piston movement to start the crushing process followed by lesser leverage coupled with longer piston movement to complete the crushing process.

It is an additional object of the present invention to provide an apparatus that provides a high degree of safety to essentially avoid the likelihood of hand damage during the crushing process. This additional safety is achieved by eliminating scissor points in the apparatus and making it almost impossible to reach any pinch points. The opposing crushing surfaces stop about one-half inch apart.

It is a further object of the present invention to provide an apparatus that can crush empty cans with a minimum effort to a size about one-sixth the original volume as compared to typical commercial can crushers which are able to achieve compression to about one-fifth the original volume.

It is an additional object of the present invention to provide a portable can crushing unit operated by hand that can be operated horizontally on the top of a storage container or can be attached to a wall in the vertical position, which is sometimes convenient.

An aspect of the invention is a can crushing apparatus to crush empty cans that includes a housing including a front end with an inside surface, a length from a rear end to the front end, and an inside channel of sufficient size and shape to receive a can with one end of the can abutting the inside surface of the front end. The apparatus further includes a handle member that includes a front end and a rear end. The apparatus also includes a hand grip means proximate the front end of the handle member to enable a person to grip and apply downward force on the front end of the handle member, and pivot means pivotally connecting at a pivot connection axis the rear end of the handle member to the housing, the handle pivoting upwardly and downwardly toward a position aligned lengthwise above the length of the housing. The apparatus further includes a piston member adapted to slide lengthwise in the channel of the housing comprising a vertical surface facing frontwardly and a convex cam surface extending frontwardly from a position proximate the rear end of the handle member frontwardly of the pivot connection axis. The apparatus also includes a cam follower means to abut the cam surface and thrust frontwardly as the handle member is pivoted downwardly and linkage means connecting the cam follower means to the piston member. The apparatus further includes a lever member including a front end and a rear end pivotally connected to a median position of the hand member, and connecting means to connect the front end of the lever member to urge the piston member frontwardly when the handle is pivoted downwardly, and to delay said urging until the cam follower means has moved frontwardly out of contact with the same surface.

It is preferred that the cam follower means include a wheel rotatably attached to a rear end of the linkage means. It is further preferred that the connecting means include a lengthwise slot proximate an end of the lever member engaging a horizontal pin member. It is also preferred that the connecting means include a lengthwise slot proximate the front end of the lever member. It is further preferred that the connecting means include a horizontal pin structurally connected to move commonly with the piston member. It is also preferred that the linkage means include a linkage member connected at a front end to the piston member and at a rear end to the cam follower means and the horizontal pin extends from a median position along a length of the linkage member. It is further preferred that the housing further include lengthwise sides each with upper edges and the handle member further comprises lengthwise edges with lower surfaces, and wherein a width of a lengthwise space formed between the upper edges of the lengthwise sides of the housing and the lower surfaces of the lengthwise edges of the handle member is greater than the width of a person's digit when the handle member is in the horizontal position. It is also preferred that the pivot means pivotally connects the rear end of the handle member to a position proximate the rear end of the housing. It is further preferred that the handle pivots downwardly toward a horizontal position aligned lengthwise above the length of the housing. It is further preferred that the apparatus further include can dispensing means including an opening in a bottom wall of the housing proximate the inside surface of the front end of the housing, the opening being of sufficient size and shape to allow a crushed can to drop downwardly out of the apparatus.

Another aspect of the invention a can crushing apparatus to crush empty cans including a housing, a handle member, a piston member, and a convex cam surface, all as above. The apparatus also includes cam follower means including a wheel to abut the cam surface and thrust frontwardly as the handle member is pivoted downwardly, linkage means including a linkage member connected at a front end to the piston member and rotatably connected at a rear end to the cam follower means, a lever member including a front end and a rear end pivotally connected to a median position of the handle member, and connecting means to connect the front end of the lever member to urge the piston member frontwardly when the handle is pivoted downwardly, and to delay said urging until the cam follower means has moved frontwardly out of contact with the cam surface, said connecting means including a lengthwise slot proximate the front end of the lever member engaging a horizontal pin member extending from a median position along a length of the linkage member. It is preferred that the housing further include lengthwise edges with lower surfaces, and wherein a width of a lengthwise space formed between the upper edges of the lengthwise sides of the housing and the lower surfaces of the lengthwise edges of the handle member is greater than the width of a person's digit when the handle member is in the horizontal position.

Yet another aspect of the invention is a method for crushing empty cylindrical cans including providing an apparatus as above that includes can dispensing means including an opening in a bottom wall of the housing proximate the inside surface of the front end of the housing, the opening being of sufficient size and shape to allow a crushed can to drop downwardly out of the apparatus. The method further includes providing a storage container for crushed cans, and support means to support the apparatus above the storage container, wherein there is an opening in the support means of sufficient size to allow crushed cans to drop into the storage container. The method also includes supporting the apparatus using the support means, placing an empty can in the inside channel, gripping the hand grip means and applying force to bring the handle downwardly toward the channel crushing the can, and allowing the crushed can to drop from the apparatus into the storage container.

DESCRIPTION OF PREFERRED EMBODIMENTS

Figure 1:
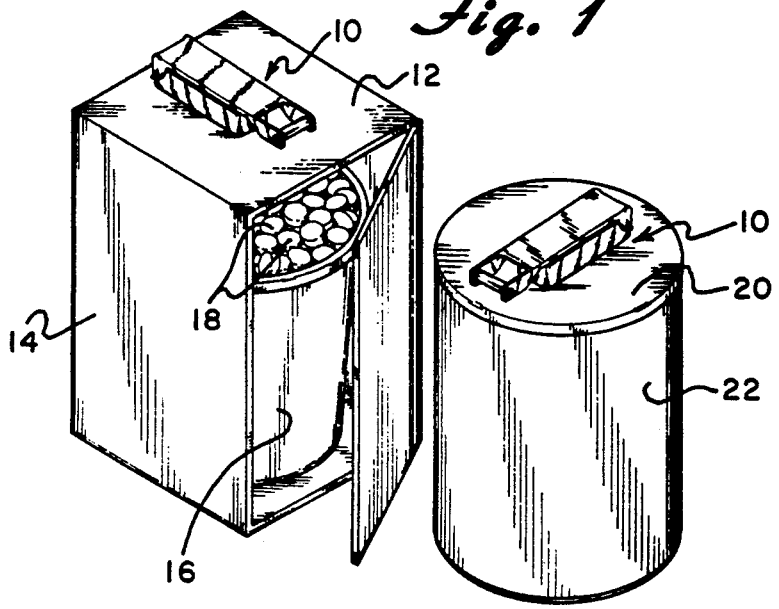
FIG. 1 is a perspective view illustrating the use of a can crusher of the present invention installed on two types of supports, both dispensing the crushed cans into a storage container.
Figure 2:
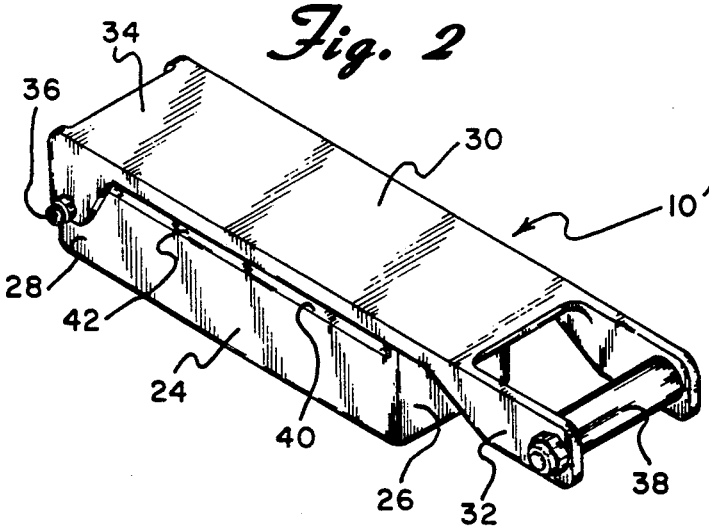
FIG. 2 is a perspective view of a can crusher of the present invention in the closed position.
Figure 3:
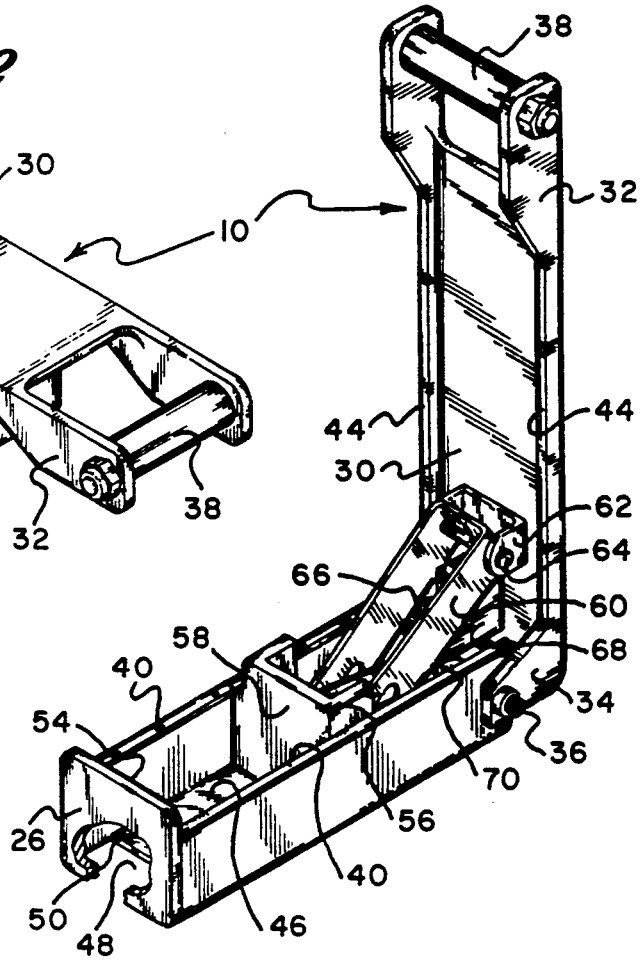
FIG. 3 is a perspective view thereof in the open position.
Figure 5:
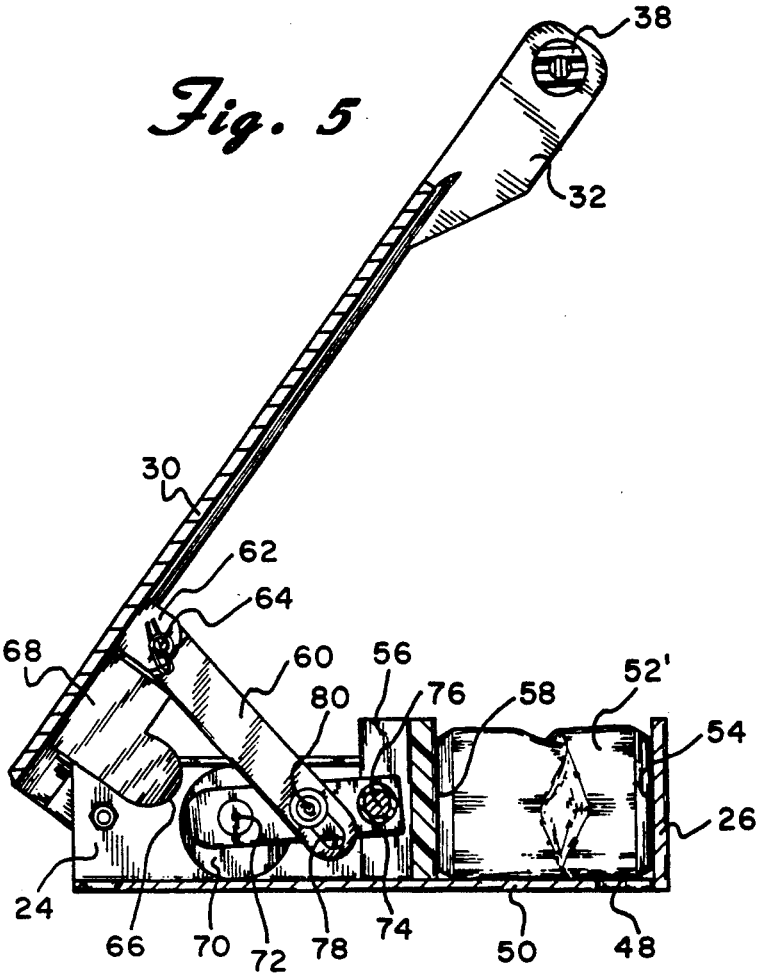
FIG. 5 is a cross-sectional view similar to that of FIG. 4 showing the crushing process at an interim stage.
Figure 4:
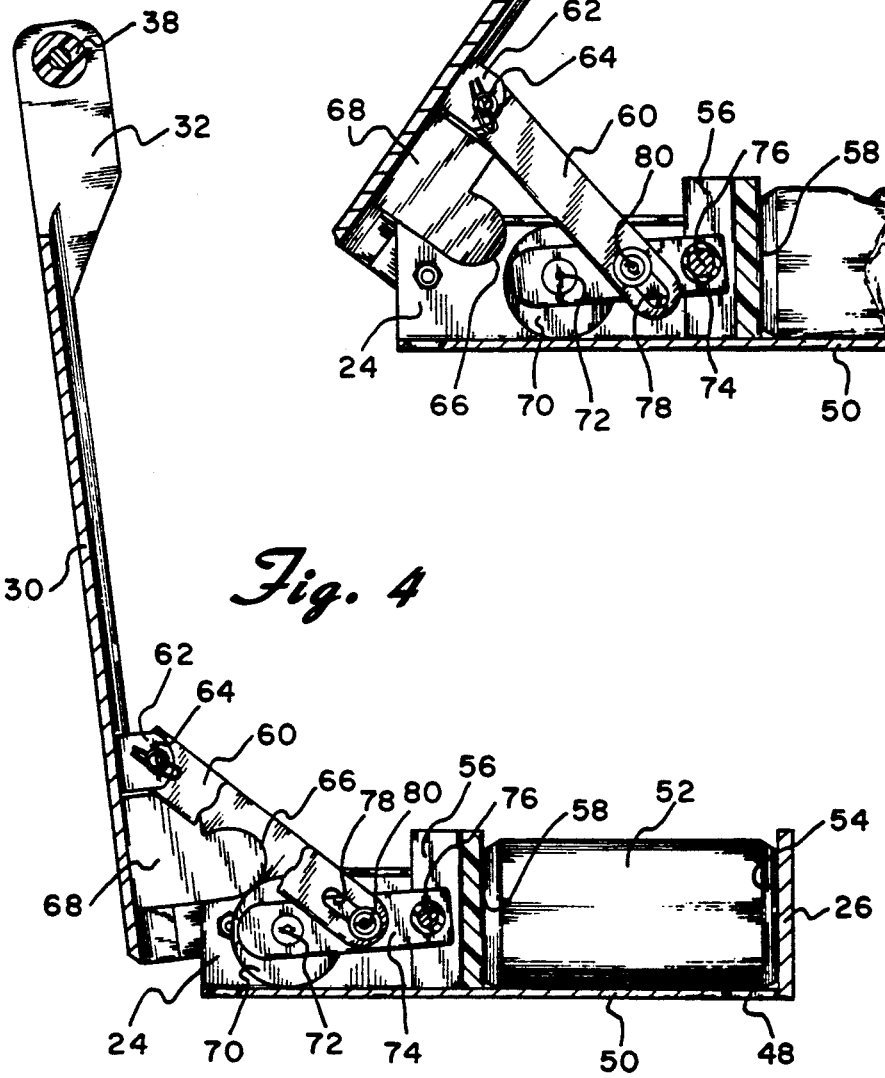
FIG. 4 is a cross-sectional view taken along lines 4—4 of FIG. 3 with an empty can inserted therein.
Figure 6:
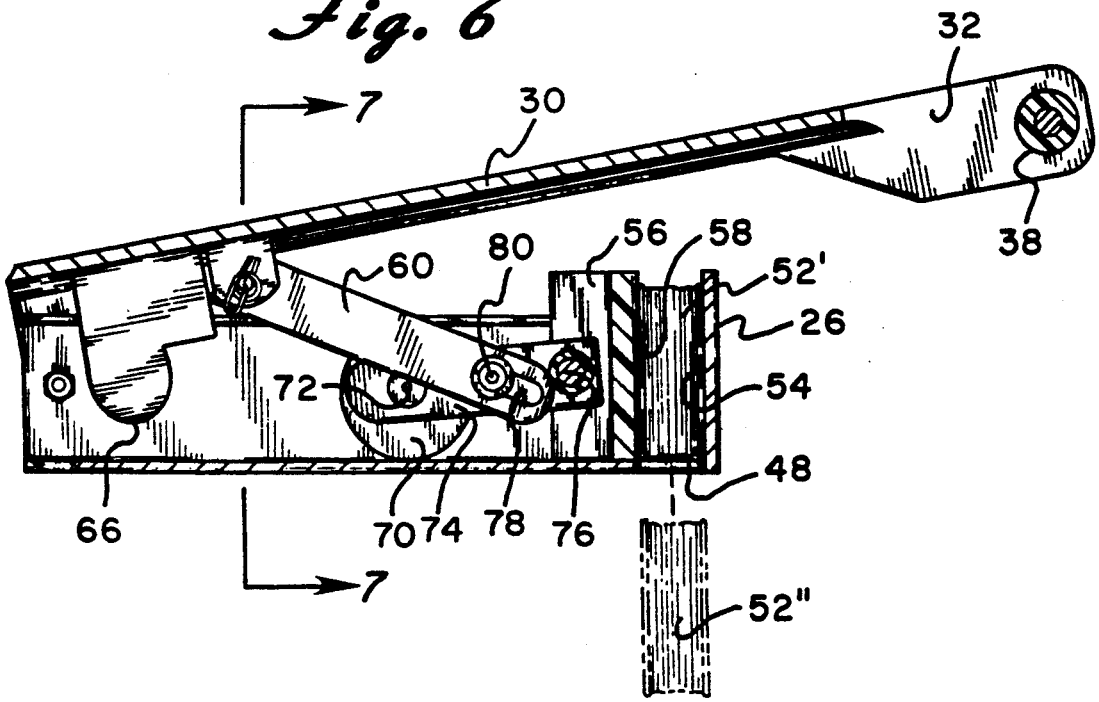
FIG. 6 is a cross-sectional view similar to that of FIGS. 4 and 5 where the crushing process has been completed and the can dispensing.
Figure 7:
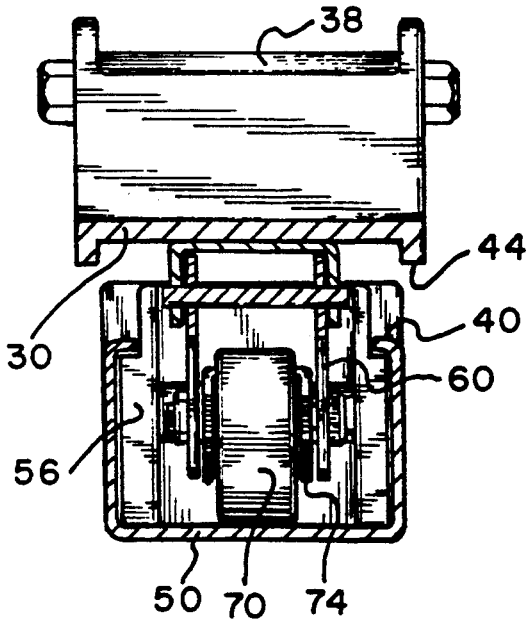
FIG. 7 is a cross-sectional view taken along lines 7—7 of FIG. 6.

As illustrated in FIG. 1, apparatus 10 is attached to horizontal surfaces such as top panel 12 of container box 14 or container top 20 of drum 22. Inside box 14 is trash container 16 into which crushed cans 18 drop from apparatus through a hole cut in top panel 12, and are stored for later pick up or delivery. As will be shown in the enlarged views of FIGS. 2 through 7, apparatus 10 includes opening 48 through which the crushed can easily fits so that it can drop through an opening in top panel 12 or an opening in container top 20 corresponding with opening 48 to allow the crushed can to drop into the respective container. As shown in FIGS. 2 and 3, apparatus 10 includes cast aluminum metal housing 24 which includes front wall 26 and rear section 28. Handle member 30 includes front end 32 and rear end 34 attached to pivot connection bolts 36 proximate rear section 28 of housing 24. Horizontal hand grip 38 is provided at front end 32 to allow the easy application of substantial downward force pivoting handle member 30 downwardly and lengthwise over housing 24. Top edges 40 of both sides of housing 24 terminate at a height to leave lengthwise slot opening 42 open below lower edges 44 of handle member 30. The width of slot opening 42 is greater than the width of fingers even when handle member 30 is in its full downward position to reduce the chance of injury. Housing 24 and handle member 30 are both constructed if one-quarter inch thick aluminum. Piston member 51 and cam follower wheel 70 are both constructed of self-lubricating engineering plastics, such as nylon, DELRIN®, and the like. Inside channel cavity 46 of housing 24 has an open top and is of sufficient size and shape to allow can 52 to fit inside with one end abutting inside surface 54 of front wall 26. The partial cut away in FIG. 3 and in particular FIG. 6, shows opening 48 in bottom wall 50 of housing 24 of sufficient size that the fully crushed can 52' easily drops through to a waiting storage container as shown in shadow view 52'. As shown in the series of FIGS. 4 through 7, can 52 is placed in channel cavity 46 to be crushed. In FIG. 4, the can sides have not yet buckled requiring the greatest amount of force. In FIG. 5 the can is partially crushed with the cylindrical walls partially collapsed requiring lesser force but greater stroke. In FIG. 6, can 52' has been fully crushed dropping through hole 48 as shown in the shadow view 52''. The can is crushed between vertical front surface 58 of piston member 56 and inside vertical surface 54 of front wall 26.

The mechanism to carry out this step is illustrated in FIGS. 3 through 7 wherein piston member 56 is urged frontwardly with lever member 60 attached through pivot connector 64 through bracket 62 attached to a median position along the length of handle member 30. In order to achieve increased force through the lever mechanism, the attachment through bracket 62 is attached less than one-quarter of the distance between pivot connection 36 and the front end of handle member 30. This lever mechanism is common in prior art hand crusher units, but is only part of the crushing mechanism of the present invention. Cam member 68 extends frontwardly from the bottom surface of handle member 30, when the handle is in the vertical position. Convex cam surface 66 engages cam follower wheel 70 rotating on axle 72 on the rear end of horizontal linkage member 74. Linkage member 74 is connected at its front end through connector pin 76 to piston member 56. Lever member 60 and linkage member 74 are constructed of one-eighth inch thick steel. As specifically shown in FIG. 4, when handle member 30 is in its full upright position, cam surface 66 is engaged against an upper section of cam follower wheel 70. As handle 30 is pulled forwardly and downwardly, cam surface 66 forces wheel 70 frontwardly linked directly to piston member 56 to start the crushing of the can with no more than about eight pounds force on handle 38. At this stage of the process, lever 60 has no effect on the crushing process in that connection at its front end to horizontal connector pin 80 is through lengthwise slot 78 opening along the length of lever member 60 for a distance of about one-half inch. Thus, when handle 30 is pulled downwardly, lever member 60 merely slides downwardly and forwardly with slot 78 sliding freely on connector pin 80 so that only cam surface 66 provides the force to begin the crushing of can 52. As shown in FIG. 5, at a point when cam surface 66 no longer can provide forward thrust on cam follower 70 since the surface moving downwardly is no longer in engagement with a side of cam follower wheel 70 that has moved forwardly out of range, the rear end of slot 78 engages pin 80 to begin to allow lever 60 transmit force to piston 56 to further crush can 52. As shown in FIG. 6, cam 66 and cam follower 70 are no longer a factor as lever 60 forces piston member 56 frontwardly to crush can 52 between the two vertical surfaces. Crushed can 52'', although shown slightly larger for clarity purposes, is about three-quarters inch thick end to end as compared to common crushed cans in commercial hand operated crushers that achieve compression to about one inch thickness. This difference achieves a twenty-five percent decrease in the volume of the crushed cans to be handled in the recycling effort. The cam levering mechanism and the lever mechanism do not operate simultaneously, but in combination, they provide firstly, a very high multiplication of force, with little piston movement followed by a reasonably high multiplication of force with substantial piston movement.

Device 10 can be easily mounted on a vertical wall with screws or bolts through holes in bottom wall 50. In this method, opening 48 is not used and the can drops out of cavity 46 through the open top into a storage bin positioned against the vertical wall.

While this invention has been described with reference to the specific embodiments disclosed herein, it is not confined to the details set forth and the patent is intended to include modifications and changes which may come within and extend from the following claims.

I claim:

1. A can crushing apparatus to crush empty cans comprising:

(a) a housing comprising:
  (i) a front end with an inside surface,
  (ii) a length from a rear end to the front end, and
  (ii) an inside channel of sufficient size and shape to receive a can with one end of the can abutting the inside surface of the front end, (b) a handle member comprising:
  (i) a front end and a rear end,
  (ii) hand grip means proximate the front end of the handle member to enable a person to grip and apply downward force on the front end of the handle member, and
  (iii) pivot means pivotally connecting at a pivot connection axis the rear end of the handle member to the housing, the handle pivoting upwardly and downwardly toward a position aligned lengthwise above the length of the housing, (c) a piston member adapted to slide lengthwise in the channel of the housing comprising a vertical surface facing frontwardly, (d) a convex cam surface extending frontwardly from a position proximate the rear end of the handle member frontwardly of the pivot connection axis, (e) cam follower means to abut the cam surface and thrust frontwardly as the handle member is pivoted downwardly, (f) linkage means connecting the cam follower means to the piston member, (g) a lever member comprising a front end and a rear end pivotally connected to a median position of the handle member, and (h) connecting means to:
  (i) connect the front end of the lever member to urge the piston member frontwardly when the handle is pivoted downwardly, and
  (ii) to delay said urging until the cam follower means has moved frontwardly out of contact with the cam surface.

2. The apparatus of claim 1 wherein the cam follower means comprises a wheel rotatably attached to a rear end of the linkage means.

3. The apparatus of claim 1 wherein the connecting means comprises a lengthwise slot proximate an end of the lever member engaging a horizontal pin member.

4. The apparatus of claim 3 wherein the connecting means comprises a lengthwise slot proximate the front end of the lever member.

5. The apparatus of claim 4 wherein the connecting means comprises a horizontal pin structurally connected to move commonly with the piston member.

6. The apparatus of claim 5 wherein the linkage means comprises a linkage member connected at a front end to the piston member and at a rear end to the cam follower means and the horizontal pin extends from a median position along a length of the linkage member.

7. The apparatus of claim 1 wherein the housing further comprises lengthwise sides each with upper edges and the handle member further comprises lengthwise edges with lower surfaces, and wherein a lengthwise space is maintained between the upper edges of the lengthwise sides of the housing and the lower surfaces of the lengthwise edges of the handle member when the handle member is in the horizontal position.

8. The apparatus of claim 1 wherein the pivot means pivotally connects the rear end of the handle member to a position proximate the rear end of the housing.

9. The apparatus of claim 1 wherein the handle pivots downwardly toward a horizontal position aligned lengthwise above the length of the housing.

10. The apparatus of claim 1 further comprising can dispensing means comprising an opening in a bottom wall of the housing proximate the inside surface of the front end of the housing, the opening being of sufficient size and shape to allow a crushed can to drop downwardly out of the apparatus.

11. A can crushing apparatus to crush empty cans comprising:

(a) a housing comprising:
  (i) a front end with an inside surface,
  (ii) a length from a rear end to the front end, and
  (ii) an inside channel of sufficient size and shape to receive a can with one end of the can abutting the inside surface of the front end, (b) a handle member comprising:
  (i) a front end and a rear end,
  (ii) hand grip means proximate the front end of the handle member to enable a person to grip and apply downward force on the front end of the handle member, and
  (iii) pivot means pivotally connecting at a pivot connection axis the rear end of the handle member to the housing, the handle pivoting upwardly and downwardly toward a position aligned lengthwise above the length of the housing, (c) a piston member adapted to slide lengthwise in the channel of the housing comprising a vertical surface facing frontwardly, (d) a convex cam surface extending frontwardly from a position proximate the rear end of the handle member frontwardly of the pivot connection axis, (e) cam follower means comprising a wheel to abut the cam surface and thrust frontwardly as the handle member is pivoted downwardly, (f) linkage means comprising a linkage member connected at a front end to the piston member and rotatably connected at a rear end to the cam follower means, (g) a lever member comprising a front end and a rear end pivotally connected to a median position of the handle member, and (h) connecting means to:
  (i) connect the front end of the lever member to urge the piston member frontwardly when the handle is pivoted downwardly, and
  (ii) to delay said urging until the cam follower means has moved frontwardly out of contact with the cam surface, said connecting means comprising a lengthwise slot proximate the front end of the lever member engaging a horizontal pin member extending from a median position along a length of the linkage member.

12. The apparatus of claim 11 wherein the housing further comprises lengthwise sides each with upper edges and the handle member further comprises lengthwise edges with lower surfaces, and wherein a lengthwise space is maintained between the upper edges of the lengthwise sides of the housing and the lower surfaces of the lengthwise edges of the handle member when the handle member is in the horizontal position.

13. The apparatus of claim 11 wherein the pivot means pivotally connects the rear end of the handle member to a position proximate the rear end of the housing.

14. The apparatus of claim 11 wherein the handle pivots downwardly toward a horizontal position aligned lengthwise above the length of the housing.

15. The apparatus of claim 11 further comprising can dispensing means comprising an opening in a bottom wall of the housing proximate the inside surface of the front end of the housing, the opening being of sufficient size and shape to allow a crushed can to drop downwardly out of the apparatus.

* * * * *